United States Patent [19]

Caveney et al.

[11] Patent Number: 4,862,928

[45] Date of Patent: Sep. 5, 1989

[54] SINGLE CABLE TIE LOADING GATE ASSEMBLY FOR AN AUTOMATIC CABLE TIE INSTALLATION TOOL

[75] Inventors: Jack E. Caveney, Hinsdale; Mark B. Richardson, Joliet, both of Ill.

[73] Assignee: Panduit Corp., Tinley Park, Ill.

[21] Appl. No.: 221,834

[22] Filed: Jul. 20, 1988

[51] Int. Cl.[4] ..... B21F 9/02

[52] U.S. Cl. ..... 140/93.2; 140/93 A

[58] Field of Search ..... 140/93.2, 93 R, 93 A

[56] References Cited

U.S. PATENT DOCUMENTS

| | | | |
|---|---|---|---|
| 3,976,108 | 8/1976 | Caveney et al. | 140/93.2 |
| 4,004,618 | 1/1977 | Turek | 140/93 A |
| 4,498,506 | 2/1985 | Moody et al. | 140/93.2 |

OTHER PUBLICATIONS

Panduit Corp.; Instruction Manual "Panduit Semi--Automatic PSA1M/PSA1.5M Cable Tie Installation Tool"; 1988; pp. 3 & 4.

*Primary Examiner*—Robert L. Spruill

*Attorney, Agent, or Firm*—Charles R. Wentzel; Mark D. Hilliard

[57] ABSTRACT

A single cable tie loading gate assembly for an automatic cable tie installation tool includes a sliding gate disposed adjacent a cable tie ejection channel. The sliding gate is movable between a closed position sealing the cable tie ejection channel and an open position allowing insertion of a cable tie into the ejection channel for subsequent pneumatic propulsion to the cable tie application mechanisms of the tool.

4 Claims, 4 Drawing Sheets

SINGLE CABLE TIE LOADING GATE ASSEMBLY FOR AN AUTOMATIC CABLE TIE INSTALLATION TOOL

FIELD OF THE INVENTION

The present invention relates generally to a tool for the automatic installation of a cable tie around a bundle of wires and more specifically to a tool that includes an improved cable tie loading gate assembly that allows loading of individual cable ties for subsequent application by the tool.

BACKGROUND ART

Prior cable tie installation tools have utilized the application of pressurized air to convey individual cable ties to a hand manipulated application tool for application to a bundle of wires. These prior tools utilize mechanisms that provide individual cable ties from a remote dispenser having a cartridge or reel containing a large number of cable ties to a conveyance mechanism for provision to an application tool. See U.S. Pat. Nos. 3,976,108 and 4,498,506 owned by common assignee, Panduit Corp. These remote dispenser tools are very desirable and have been highly successful for situations where maximum volume and speed of application is needed but in situations where lesser application speeds are acceptable the increased complexity and cost associated with providing a specialized dispenser to dispense a single cable tie from a large number of cable ties limits the usefulness of the remote dispenser tools.

In order to address the needs of the industry for a simpler, less expensive automatic cable tie installation tool, Panduit Corp. has manufactured a hand tool member similar to the one disclosed in U.S. Pat. No. 3,976,108, but specially modified by adding a window in the left, rear side of the tool that allows an operator to grasp the tool with his right hand and insert a single tie with his left hand into a revolving shuttle mechanism disposed within the tool. Upon sequenced application of pressurized air to a spring loaded piston connected to the shuttle, the shuttle rotates to correctly position the cable tie for subsequent propulsion through the tool's cable tie conveyance tube. The piston driven revolving shuttle mechanism of this tool member was undesirably complex, having many interacting parts that increased the cost of manufacture and maintenance of the tool. This tool was also prone to jam due to the many moving parts of the cable tie shuttle mechanism, a cable tie jammed within the tie loading mechanism requiring costly and time consuming disassembly of the tool since the tie loading mechanism was an integral part of the tool.

SUMMARY OF THE INVENTION

Among the several objects of the proposed invention may be noted the provision of an improved single cable tie gate assembly for use with an automatic cable tie application tool that utilizes fewer and simpler interacting parts to reduce the cost of manufacture and maintenance of the assembly; the provision of such a gate assembly that minimizes cable tie jams for increased reliability and allows simple clearing of a jammed cable tie without complicated disassembly of the tool; and the provision of such a gate assembly that allows either left-handed or right-handed operation of the tool. These and other objects, together with the advantages thereof over existing prior art forms, which will become apparent from the following specification, are accomplished by means hereinafter described.

In general, a single cable tie gate assembly for use with an automatic cable tie application tool includes a sliding gate means disposed adjacent a cable tie ejection channel, the sliding gate means being movable between a closed position sealing the cable tie ejection channel and an open position allowing insertion of a cable tie into the channel through a cable tie insertion opening, the sliding gate means being resiliently biased towards the closed position. The cable tie ejection channel communicates with a source of pneumatic pressure at a point behind the head of a cable tie loaded within the channel and communicates with the cable tie conveyance tube of the tool such that an application of pneumatic pressure behind the head of a loaded cable tie propels the cable tie through the cable tie conveyance tube of the tool for application by the tool.

PREFERRED EMBODIMENT FOR CARRYING OUT THE INVENTION

A cable tie loading gate assembly embodying the concept of the present invention is designated generally by the numeral 20 in the accompanying drawings.

Figure 1:
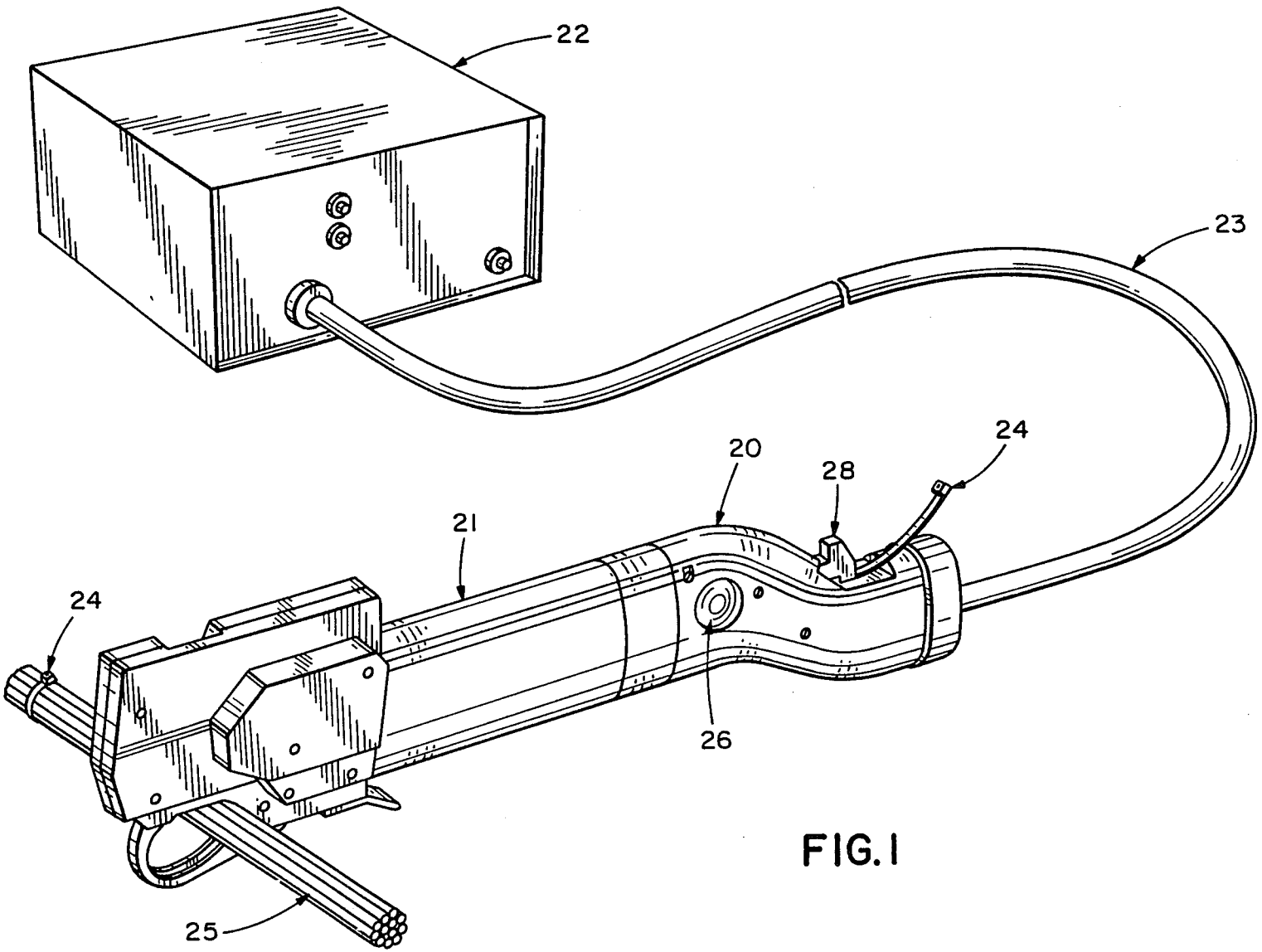
FIG. 1 is a perspective view of an automatic cable tie application tool which includes a single tie gate assembly embodying the concept of the present invention.

As seen in FIG. 1 gate assembly 20 is utilized in conjunction with a cable tie application tool 21 and a pneumatic and electronic control unit 22 which is connected to gate assembly 20 by a hose 23. Hose 23 contains pressurized air supply tubes and electronic control cables for the operation of tool 21. The construction and operation of tool 21 which is utilized to apply cable ties 24 to a wire bundle 25 are described in detail in U.S. Pat. No. 4,498,506 which is incorporated herein by reference. Gate assembly 20, with minor modifications to the control sequence of tool 21 to account for single instead of multiple cable tie feeding, is completely compatible with the tool described in U.S. Pat. No. 4,498,506.

Figure 10:
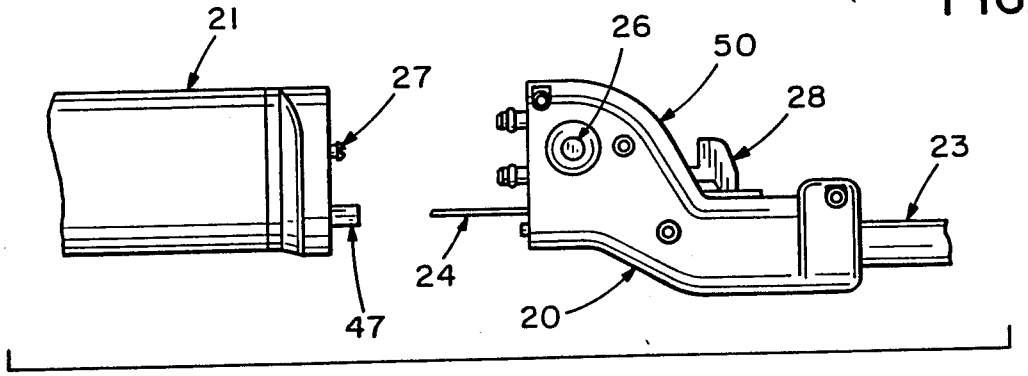
FIG. 10 is a side view of the gate assembly showing the gate assembly disconnected from the application tool.

As seen in FIG. 10, gate assembly 20 is easily detachable from tool 21 by pushing a button 26 which disengages a pair of jaws (not shown) from a latching post 27.

As best seen in FIGS. 2–5 and 9, the working mechanism of gate assembly includes only two moving parts, an entry gate 28 and a cable tie hold down bar 29 which are slidably mounted within opposing tracks 30 formed on the inner surfaces of first and second inner housing members 31 and 32, first and second housing members 31 and 32 being secured around gate 28 and bar 29 by bolts 33 and nuts 34. Tracks 30 include upper inset grooves 35 that receive a positioning lug 36 formed on the upper surface of entry gate 28 to limit the extent of inward and outward translation of gate 28. The inner end of cable tie hold down bar 29 includes an inner flange 37 which is approximately twice the height of the medial portion of bar 29 and substantially equal to the height of tracks 30. Inner flange 37 includes an inwardly directed spring boss 38 that accepts spring 39 to bias bar 29 outwardly. The outer end of bar 29 includes a downwardly projecting head 40 having an inclined lead-in surface 41.

Entry gate 28 is mounted in a coextensive, superimposed disposition over bar 29 with its inner extent abutting a depression in the outer surface of flange 37 such that inwardly directed force applied to head 42 of gate 28 or applied to leading surface 41 of bar 29 translates entry gate 28 and bar 29 inwardly as a unit against the bias of spring 39. Entry gate 28 includes an under cut surface at its outer end, directly opposing bar 29 and a spring bore which secures a spring 43. Spring 43 engages a directly opposing spring boss 44 formed on the upper surface of head 40 to bias cable tie hold down bar 29 downwardly, away from gate 28.

A cable tie ejection channel 45 is formed in inner housing members 31 and 32 below bar 29 with the outermost extent of channel 45 having a cable tie insertion opening which is sealed by bar 29 when entry gate 28 and bar 29 are at their outermost extent or in the closed position. Channel 45 at a first end is in communication with a pressurized air supply tube 46 and at an opposed end with a cable tie conveyance tube 47 which is interconnected to channel 45 by adapter 48.

Figure 6:
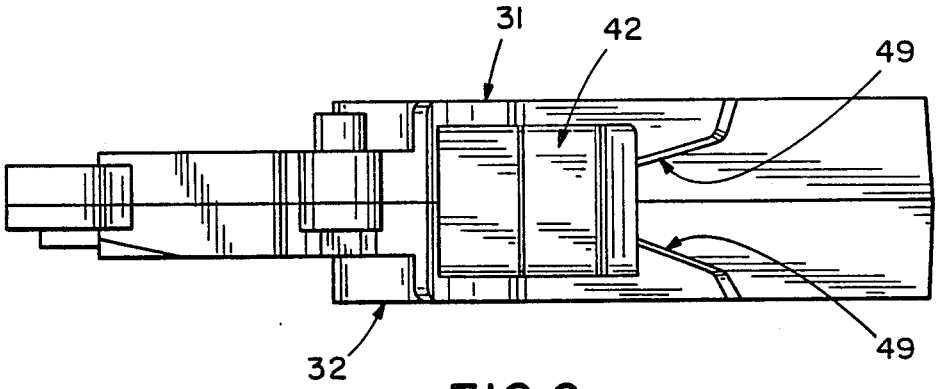
FIG. 6 is a top view of the inner housing of the gate assembly.
Figure 7:
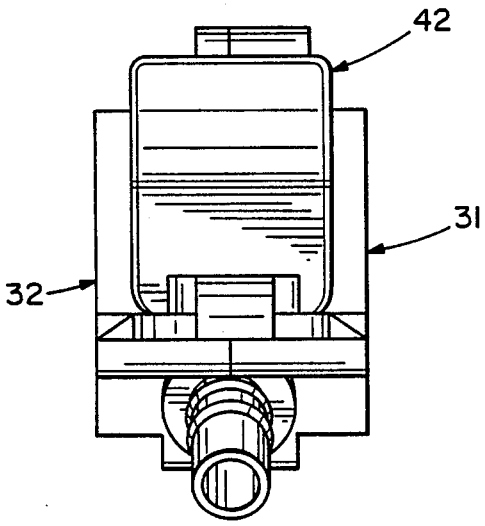
FIG. 7 is a rear view of the inner housing of FIG. 6.
Figure 8:
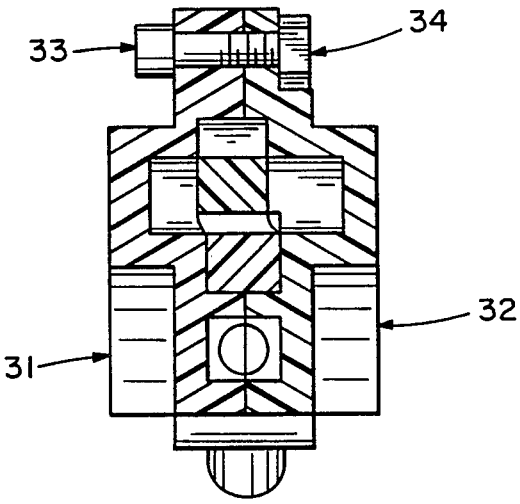
FIG. 8 is a sectional view of the innerhousing of FIG. 6 taken along line 8—8 of FIG. 2.
Figure 9:
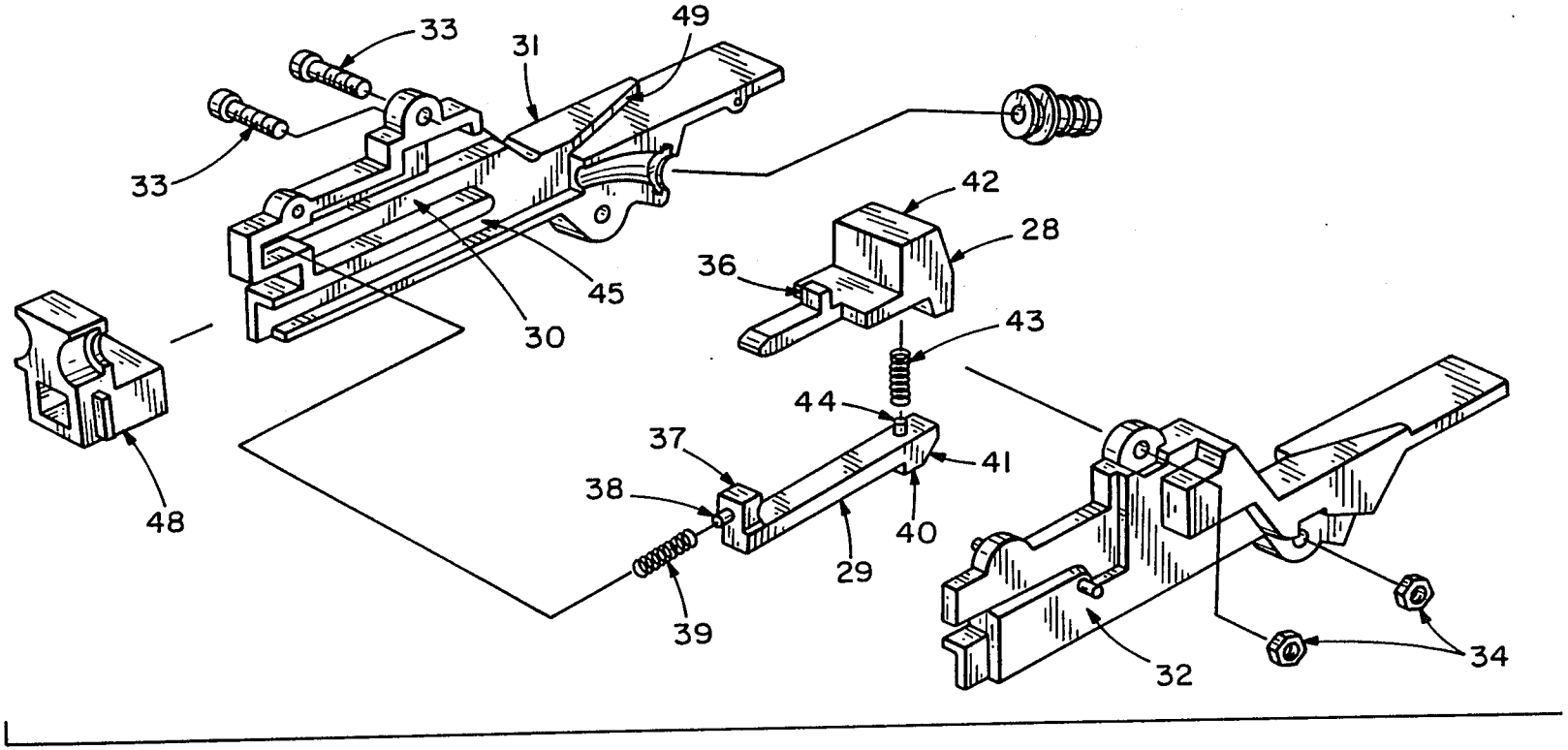
FIG. 9 is an exploded isometric view of the inner housing members and moving parts of the gate assembly.

As best seen in FIG. 6, a pair of inwardly tapering walls 49 position and guide the tip of a cable tie into precise alignment with gate assembly 20. In preferred form gate assembly 20 is disposed with the cable tie insertion opening disposed along the top of the tool, allowing the tool to be used equally well by left-handed or right-handed operators.

Gate assembly also includes outer housings 50 which enclose and mount pneumatic supply tubes 51 and an electronic control cable 52 for detachable connection with cable tie application tool 21.

Figure 2:
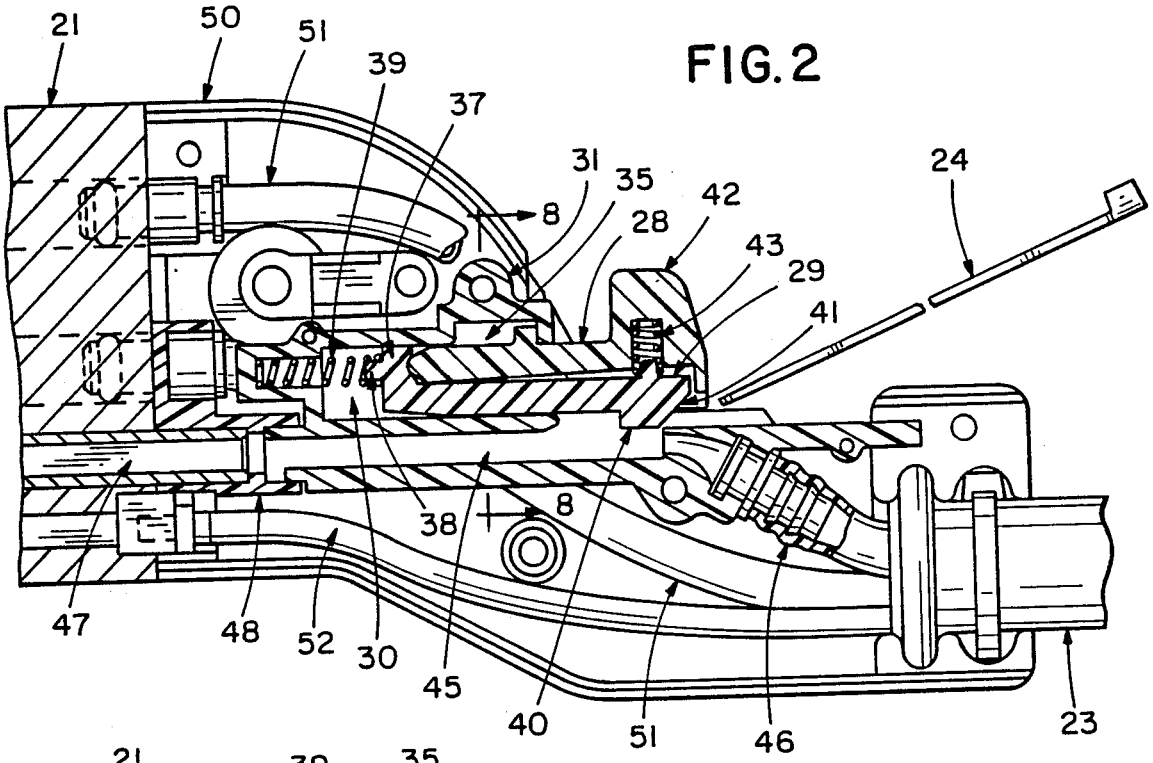
FIG. 2 is a partial sectional view of the cable tie application tool of FIG. 1 showing the gate assembly embodying the concept of the present invention just before a cable tie is inserted therein.
Figure 3:
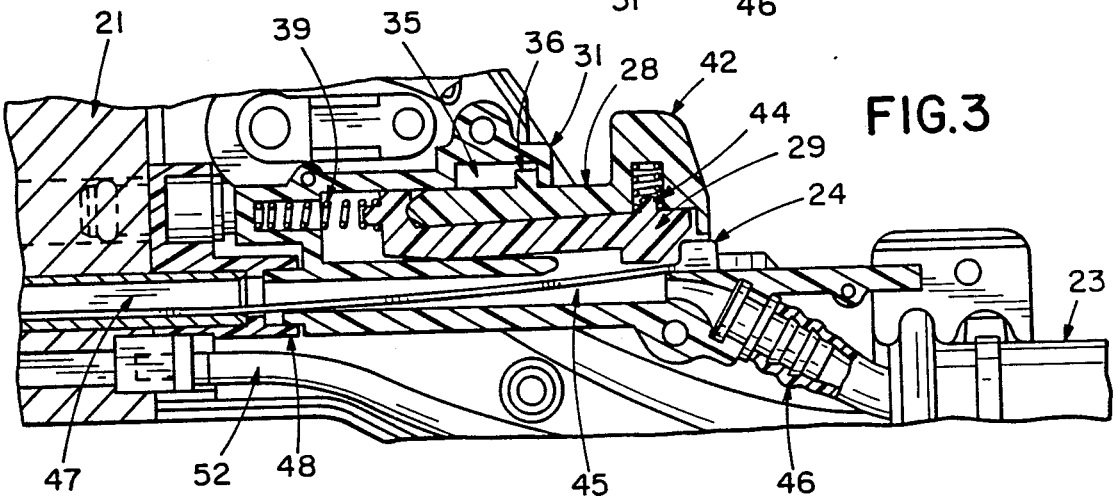
FIG. 3 is a partial sectional view of the gate assembly of FIG. 2 illustrating a cable tie partially inserted within the gate assembly.
Figure 4:
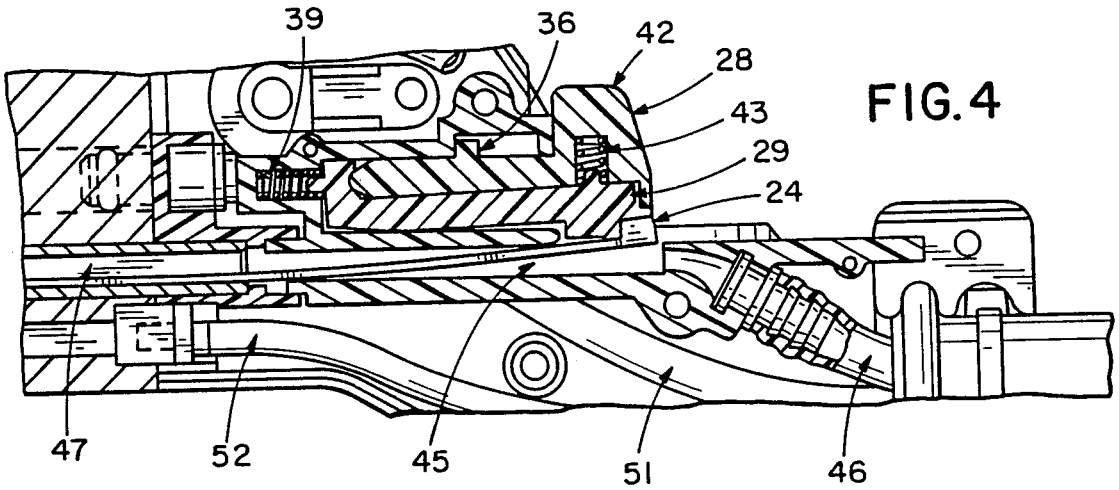
FIG. 4 is a partial sectional view of the gate assembly of FIG. 2 illustrating the cable tie just after its head is fully inserted within the gate assembly.
Figure 5:
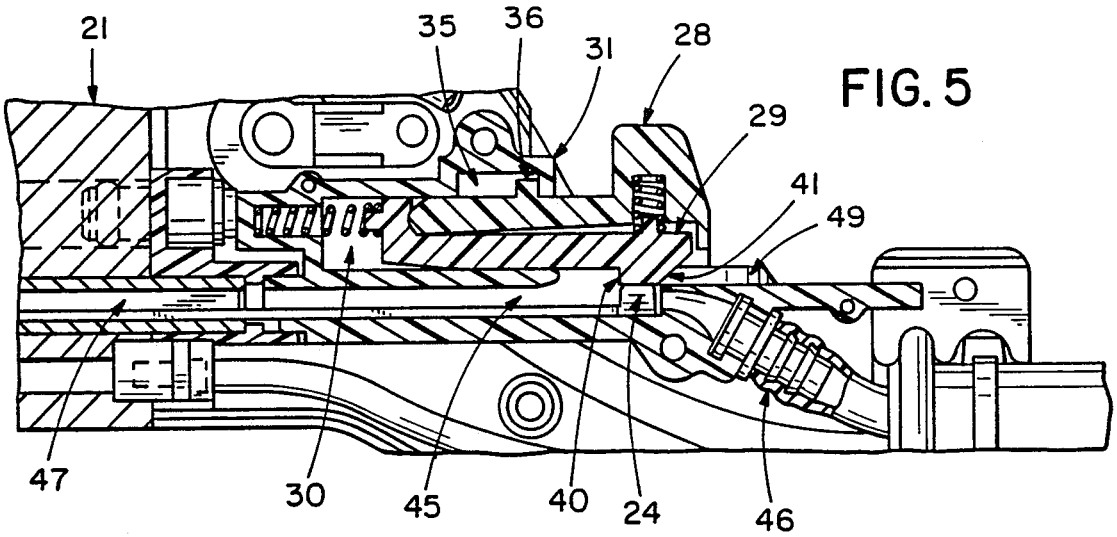
FIG. 5 is a partial sectional view of the gate assembly of FIG. 2 illustrating the cable tie positioned for subsequent propulsion to the tool for application.

Referring to FIGS. 2–5, a cable tie is loaded into gate assembly 20 by grasping a single cable tie 24, positioning the head of the cable upwardly as shown in FIG. 2, and inserting the strap of the cable tie against lead-in surface 41 of cable tie hold down bar 29, against the bias of spring 39, moving entry gate 28 and bar 29 inwardly. Continued insertion of cable tie 24, as seen in FIGS. 3 and 4 directs the strap of cable tie 24 into cable tie conveyance tube 47 and positions the head of cable tie 24 completely over cable tie ejection channel 45 to position entry gate 28 in a fully open position. As seen in FIG. 5, downwardly biased bar 29 and the natural resiliency of cable tie 29 combine to push cable tie 24 into channel 45; bar 29 biasing cable tie 24 against the bottom of channel 45, lightly holding cable tie 24 in place until an application of pressurized air behind the head of cable tie 24 from tube 46 overcomes this bias and propels cable tie 24 through tube 47 to tool 21. If a cable tie should jam within the tool, gate assembly 20 can be easily separated from tool 21 by depressing button 26, as seen in FIG. 10, grasping cable tie 24 by its forwardly projecting strap and withdrawing it from gate assembly 20.

A cable tie 24 positioned within channel 45 as seen in FIG. 5 is ready for application with actuation of the automatic cable tie application tool cycle. The following preferred sequence of tool operations are effected by pneumatic and electronic control unit 22 which contains the necessary pneumatic circuitry and digital control circuitry. Initially an application of pressurized air to pneumatic retainer slide cylinder of the tool extends the cable tie head retainer slide; after a 45 millisecond delay, pressurized convey air is supplied to tube 46 for 49 milli-seconds thus propelling cable tie 24 into tool 21; 20 milli-seconds after convey air begins, the air motor of tool 21 is turned on for the duration of the cycle; the upper jaw of the tool is then actuated threading the strap of cable tie 24 through its head and into contact with the gripper mechanism of the tool which tensions and severs the strap of the cable tie; and immediately after severance of the strap a second burst of pressurized air is applied to tube 46 and thus conveyance tube 47 of tool 21 insuring the tube is cleared for the next cycle.

What is claimed is:

1. A single cable tie loading gate assembly for an automatic cable tie installation tool that utilizes pneumatic pressure to transport a cable tie through a cable tie conveyance tube to the cable tie application mechanisms of the tool, comprising:

a sliding gate means disposed adjacent a cable tie ejection channel, the sliding gate means being movable between a closed position sealing the cable tie ejection channel and an open position allowing insertion of a cable tie into the channel through a cable tie insertion opening, the sliding gate means being resiliently biased towards the closed position, the cable tie ejection channel communicating with a source of pneumatic pressure at a point behind the head of a cable tie loaded within the channel and communicating with the cable tie conveyance tube of the tool, whereby an application of pneumatic pressure behind the head of a loaded cable tie propels the cable tie through the cable tie conveyance tube of the tool for application by the tool.

2. A gate assembly as set forth in claim 1, wherein said sliding gate means includes an entry gate slidably mounted in superimposed disposition over a cable tie hold-down bar which is resiliently biased away from the entry gate adjacent outer ends of the entry gate and the cable hold-down bar, and wherein the cable hold-down bar includes a downwardly extending head portion that is disposed to bias the head of a cable tie loaded within the cable tie ejection channel against the floor of the channel.

3. A gate assembly as set forth in claim 2, wherein a cable tie insertion opening is disposed adjacent the top edge of the cable tie installation tool whereby a cable tie can be easily loaded into the gate assembly by either left-handed or right-handed operators.

4. A gate assembly as set forth in claim 2, wherein the gate assembly includes disengagement means for separating the gate assembly from the tool and wherein the cable tie ejection channel of the gate assembly is shorter in length than a cable tie loaded therein whereby separation of the gate assembly from the tool allows the strap of the cable tie to project out of the gate assembly to facilitate the removal of a jammed cable tie from the assembly.

* * * * *